US009777416B2

(12) United States Patent
Jáuregui et al.

(10) Patent No.: US 9,777,416 B2
(45) Date of Patent: Oct. 3, 2017

(54) MOVABLE GUIDE FOR A SEWING MACHINE

(71) Applicant: LEAR CORPORATION, Southfield, MI (US)

(72) Inventors: Alejandro Jáuregui, Juarez (MX); Oscar Fernando Dominguez, El Paso, TX (US); Efren Arteaga, Juarez (MX); Jose Rodriguez, Juarez (MX); Hector Arturo Navarro Barraza, Juarex (MX)

(73) Assignee: LEAR CORPORATION, Southfield, MI (US)

( * ) Notice: Subject to any disclaimer, the term of this patent is extended or adjusted under 35 U.S.C. 154(b) by 127 days.

(21) Appl. No.: 14/674,091

(22) Filed: Mar. 31, 2015

(65) Prior Publication Data

US 2016/0289877 A1 Oct. 6, 2016

(51) Int. Cl.

| | |
|---|---|
| ***B65H 59/00*** | (2006.01) |
| ***D05B 23/00*** | (2006.01) |
| ***D05B 43/00*** | (2006.01) |

(52) U.S. Cl.

CPC ..... *D05B 23/00* (2013.01); *D05B 43/00* (2013.01)

(58) Field of Classification Search

CPC ..... D05B 43/00; D05B 15/00; D05B 69/12; D05B 19/08; D10B 2501/042

USPC ..... 112/270, 14, 50, 220, 102.5, 103

See application file for complete search history.

(56) References Cited

U.S. PATENT DOCUMENTS

| | | | | |
|---|---|---|---|---|
| 1,137,356 | A | 4/1915 | Schoenky | |
| 1,283,135 | A | 10/1918 | Fortin | |
| 2,554,168 | A | 5/1951 | Becker | |
| 2,876,721 | A | 3/1959 | Burke | |
| 3,011,461 | A | 12/1961 | Johnson | |
| 3,875,881 | A | 4/1975 | Marforio | |
| 4,998,964 | A * | 3/1991 | Golia | D05B 21/00 112/102.5 |
| 5,027,727 | A | 7/1991 | Ulmer | |
| 5,251,557 | A | 10/1993 | Rohr | |
| 5,503,093 | A * | 4/1996 | Katou | D05B 21/00 112/103 |
| 6,725,791 | B2 | 4/2004 | Mukai | |
| 8,640,638 | B2 * | 2/2014 | Lee | D05B 3/24 112/470.05 |
| 8,738,171 | B2 * | 5/2014 | Kato | D05B 19/02 112/102.5 |
| 8,794,166 | B2 * | 8/2014 | Makover | D05B 21/00 112/102.5 |
| 8,844,453 | B2 | 9/2014 | Kondou | |
| 8,899,164 | B2 * | 12/2014 | Magara | D05C 9/06 112/470.18 |

(Continued)

OTHER PUBLICATIONS

PCT International Search Report and Written Opinion of the International Searching Authority dated Apr. 21, 2016, Application No. PCT/US2016/018157, Applicant Lear Corporation, 8 Pages.

*Primary Examiner* — Tejash Patel

(74) *Attorney, Agent, or Firm* — Brooks Kushman P.C.

(57) ABSTRACT

A sewing machine according to the present disclosure includes a base and a support member that is movable with respect to the base between multiple use positions. The support member is configured to support multiple tools such that a selected one of the tools is useable when the support member is positioned in each of the use positions.

21 Claims, 4 Drawing Sheets

(56) References Cited

U.S. PATENT DOCUMENTS 8,919,268 B2 * 12/2014 Chen ..... D05C 11/06
112/163

* cited by examiner

MOVABLE GUIDE FOR A SEWING MACHINE

TECHNICAL FIELD

The present disclosure relates to sewing machines.

BACKGROUND

Sewing machines may be used in a variety of sewing operations to produce various products, such as trim covers for vehicle seats. A variety of different tools, such as guides, may be attached to the sewing machines to facilitate attachment of components during the sewing operations.

If a single sewing machine is to be used with multiple different sewing operations that each involve use of a different tool, a sewing machine operator may need to manually change tools, which is a time consuming process. Alternatively, a dedicated sewing machine may be configured for each sewing operation, which may result in significant equipment expenses.

SUMMARY

A sewing machine according to the present disclosure includes a base and a support member that is movable with respect to the base between multiple use positions. The support member is configured to support multiple different tools such that a selected one of the tools is useable when the support member is positioned in each of the use positions.

While exemplary embodiments are illustrated and disclosed, such disclosure should not be construed to limit the claims. It is anticipated that various modifications and alternative designs may be made without departing from the scope of the invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
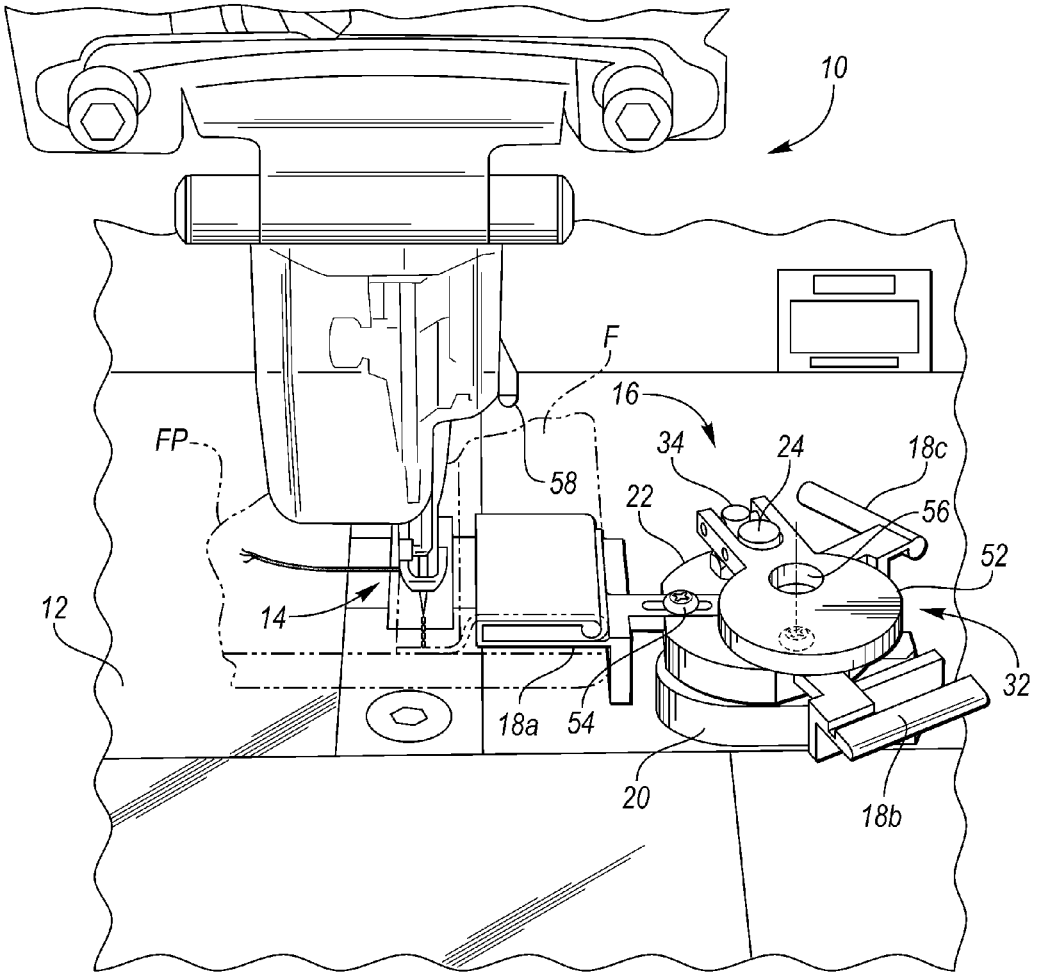
FIG. 1 is a fragmentary perspective view of a sewing machine, according to the present disclosure, including a sewing head movably supported on a base, and a guide assembly positioned proximate the sewing head, wherein the guide assembly includes a movable support member for supporting multiple tools, and a locking device for locking the support member with respect to the base in each of multiple different use positions.

FIG. 1 shows a sewing machine 10, according to the present disclosure, that can be used for multiple different sewing operations. For example, the sewing machine 10 may be used to sew together multiple flexible parts, such as flexible panels or pieces of fabric, vinyl, and/or leather. As another example, the sewing machine 10 may be used to sew a fastener F (e.g., plastic retainer, clip, etc.) to a flexible panel FP, such as shown in phantom lines in FIG. 1. As a more specific example, the sewing machine 10 may be used to sew together multiple flexible panels and/or fasteners to form a trim cover for use with a motor vehicle seat.

Figure 2:
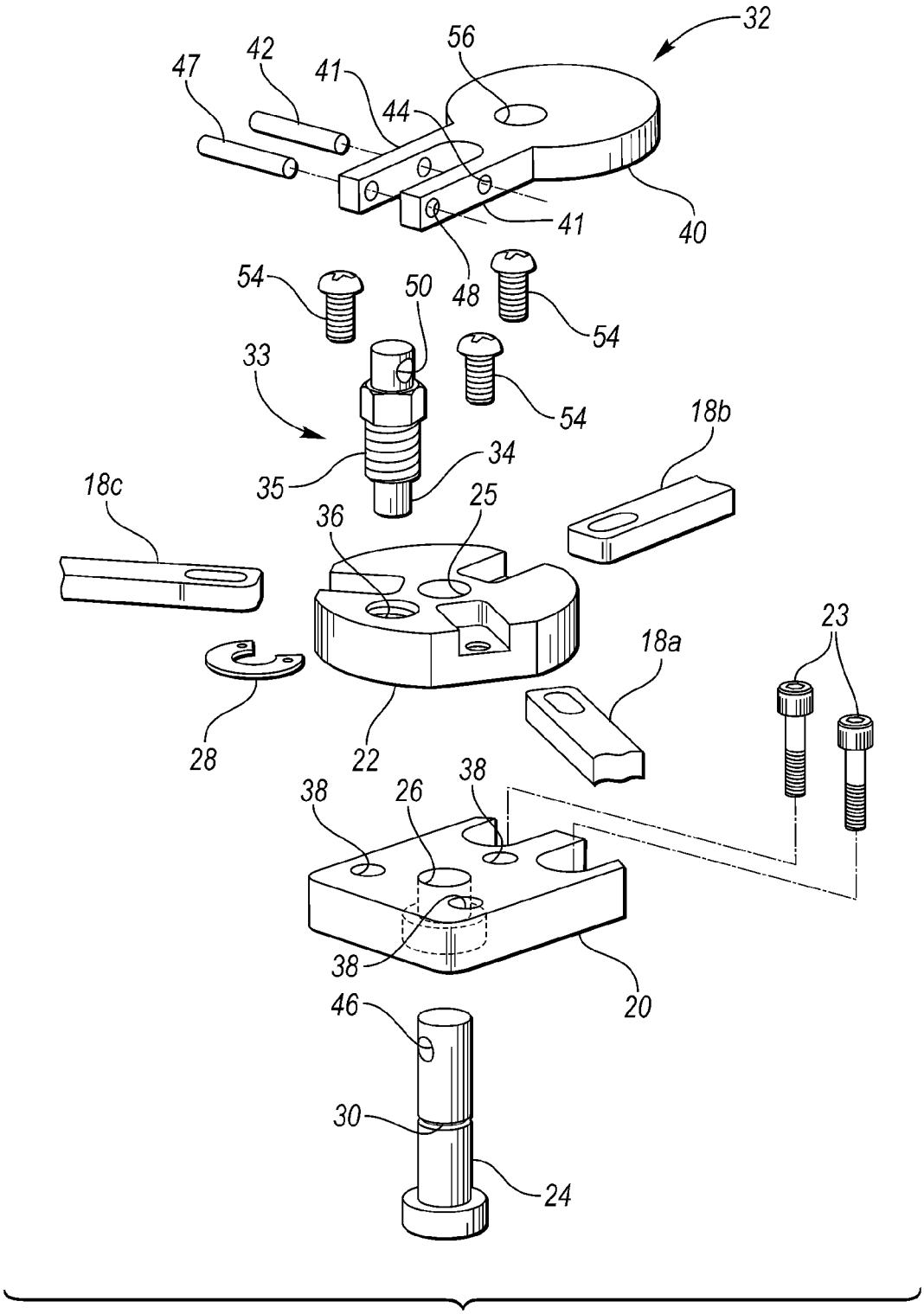
FIG. 2 is an exploded perspective view of the guide assembly shown in FIG. 1.

Referring to FIGS. 1 and 2, the sewing machine 10 may include a main support member or structure, such as body or base 12, a sewing head 14 movably associated with (e.g., supported by) the base 12, and a support or guide assembly 16 that is associated with (e.g., supported by) the base 12 and configured to support multiple different tools 18 (e.g., 18*a*, 18*b*, 18*c*, wherein each tool may have a different size and/or shape compared with the other tools) for multiple different sewing operations (fragmentary views of the tools 18 are shown in FIG. 2). The sewing machine 10 may also include one or more storage receptacles or bins (not shown) for storing different parts (e.g., different fasteners, such as different sized and/or different shaped retainers, clips, etc.) that may be used in the different sewing operations. Furthermore, each tool 18 may be useable with a particular type of part that is stored in only one of the bins (e.g., the parts in a particular bin may all be the same or similar, while the parts in each bin may all be different, e.g., different size and/or different shape, than the parts in each other bin). For example, each tool 18 may be configured to receive a particular type of part and only in a particular orientation, such that the tool 18 provides a poka-yoke (i.e., mistake-proofing) function. As a more detailed example, each tool 18 may have a particular part receiving opening that is configured to receive a particular type of part when the part is inserted into the tool in a particular direction and/or position. As a result, each tool 18 may function as a part guide for guiding a particular type of part into a desired position for a particular sewing operation. Alternatively or in addition, each tool 18 may function as a sewing guide during a particular sewing operation to ensure proper spacing of parts being joined together and/or to ensure proper location of a sewn stitch or seam.

In the embodiment shown in FIGS. 1 and 2, the guide assembly 16 includes a base 20 that is attachable to the base 12, and a support member 22 that is supported by the base 12 such that the support member 22 is movable with respect to the base 20 between multiple use positions (e.g., two or more use positions). Furthermore, the support member 22 is configured to support the tools 18 such that a selected one of the tools 18 is useable for sewing operations when the support member 22 is positioned in each of the use positions.

While the base 20 may be attached to the base 12 in any suitable manner, in the embodiment shown in FIGS. 1 and 2, the base 20 is connected to the base 12 with multiple fasteners 23, such as bolts or screws. Likewise, the support member 22 may be attached to the base 20 in any suitable manner such that support member 22 is movable with respect to the base 20. For example, the support member 22 may be rotatably mounted on the base 20 such that the support member 22 is rotatable between the use positions. As a more detailed example, the support member 22 may be rotatably mounted on a spindle 24 that is connected to, or otherwise associated with, the base 20 and that extends through a central opening 25 of the support member 22. While the spindle 24 may be connected to the base 20 in any suitable manner, in the embodiment shown in FIG. 2, the spindle 24 is configured to extend through a central opening 26 of the base 20, and the spindle 24 includes an enlarged head that is received in an enlarged recess formed on an underside or bottom of the base 20. The support member 22 may be secured to the spindle 24 and the base 20 by a fastener 28, such as a spring clip, that is receivable in a circumferential groove 30 formed in the spindle 24.

The guide assembly 16 may also include a locking device 32 for locking the support member 22 in each of the use positions. In the embodiment shown in FIGS. 1 and 2, the locking device 32 includes a lock pin assembly 33 having a lock pin 34 that is movably received in a lock body 35 (e.g., threaded lock body), and the lock pin 34 is urged downwardly by a spring (not shown) that is positioned between and engaged with the lock pin 34 and lock body 35. The lock pin 34 is extendable through an opening 36 in the support member 22 and cooperable with lock features 38 (e.g., recesses or openings) of the base 20 to lock the support member 22 with respect to the base 20. For example, the base 20 may be provided with two or more lock features 38, and the lock pin 34 may be engageable with a respective one of the lock features 38 when the support member 22 is in each of two use positions. In the embodiment shown in FIGS. 1 and 2, the base includes three lock features 38, and the lock pin 34 is configured to engage a respective one of the lock features 38 when the support member 22 is in each of three use positions. In another embodiment, the guide assembly 16 may be configured such that the support member 22 is movable between any suitable number of use positions, such as four or more use positions, and the locking device 32 may be configured to lock the support member 22 in each use position.

The locking device 32 may further include a lever 40 associated with the lock pin 34 for moving the lock pin 34 with respect to the base 20. In the embodiment shown in FIGS. 1 and 2, the lever 40 is pivotally connected to or otherwise associated with the spindle 24, and is further connected to or otherwise associated with the lock pin 34. For example, the lever 40 may have two arms 41 that define an opening for receiving the spindle 24, and the arms 41 may be connected to the spindle 24 with a first connecting member 42, such as a first pin, that extends through a first set of openings 44 in the arms 41 and an opening 46 in the spindle 24. Likewise, the lever 40 may be connected to the lock pin 34 with a second connecting member 47, such as a second pin, that extends through a second set of openings 48 in the arms 41 and an opening 50 in the lock pin 34.

Figure 3:
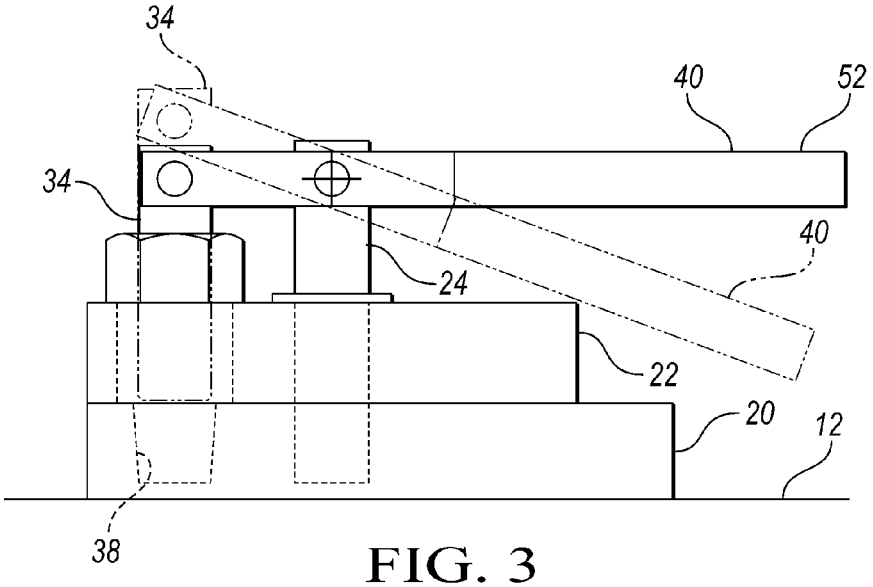
FIG. 3 is a side view of the guide assembly showing a lock pin of the locking device in a locked position (solid lines) and an unlocked position (phantom lines)

The lever 40 is operable to move the lock pin 34 from a locked position shown in FIG. 1 and in solid lines in FIG. 3, in which the lock pin 34 is engaged with one of the lock features 38, to an unlocked position shown in phantom lines in FIG. 3, in which the lock pin 34 is disengaged from the lock features 38 so that the support member 22 may be moved with respect to the base 20. For example, an operator may push down on an end 52 of the lever 40 and pivot the lever 40 with respect to the spindle 24 to thereby raise the lock pin 34 from the locked position to the unlocked position. As shown in FIG. 3, each lock feature 38 may have a tapered shape to reduce or eliminate free play between the lock pin 34 and the support member 22 when the lock pin 34 is in the locked position. For example, each lock feature 38 may have a conical or frustoconical shape including tapered walls (e.g., angled 3 degrees or less with respect to a vertical line) that are engageable with the lock pin 34.

An example method of mounting the guide assembly 16 onto the base 12 will now be described with reference to FIGS. 1 and 2. First, the spindle 24 may be inserted into the opening 26 of the base 20, and the base 20 may be secured to the base 12 of the sewing machine 10 using the fasteners 23. Next, the support member 22 may be positioned on the spindle 24 such that the support member 22 rests against the base 20, and the fastener 28 may be inserted into the channel 30 of the spindle 24 to rotatably secure the support member 22 to the base 20. As another example, a washer or bearing (not shown) may be positioned between the support member 22 and the base 20 to facilitate rotation of the support member 22 with respect to the base 20. The lock pin assembly 33 may then be connected to the support member 22, such as by screwing the lock body 35 into the threaded opening 36 of the support member 22. Next, the lever 40 may be attached to the spindle 24 and lock pin 34 with the first and second connecting members 42 and 47, respectively. Finally, the tools 18*a*, 18*b* and 18*c* may be connected to the support member 22 in any suitable manner, such as with fasteners 54 (e.g., screws or bolts). As shown in FIGS. 1 and 2, the lever 40 may also be provided with an opening 56 to provide access to a fastener 54 that may be positioned beneath the lever 40.

The above steps may instead be performed in any suitable order that allows assembly of the guide assembly 16, and mounting of the guide assembly 16 onto the base 12 of the sewing machine 10. For example, the lock pin assembly 33 and the tools 18*a*, 18*b* and 18*c* may be pre-assembled to the support member 22 before the support member 22 is positioned on the spindle 24. As another example, all of the components of the guide assembly 16 may be assembled together, and then the guide assembly 16 may be attached to the base 12 of the sewing machine 10, provided that the base 20 of the guide assembly 16 is configured to allow access to the fasteners 23 when the guide assembly 16 fully assembled.

Operation of the sewing machine 10 will now be described with reference to FIGS. 1-4. First, an operator may push lever end 52 downwardly to move the lock pin 34 to the unlocked position so that the support member 22 may be rotated with the spindle 24 to a desired first use position in which a desired tool 18*a*, 18*b*, or 18*c* is positioned proximate the sewing head 14 (e.g., aligned with the sewing head 14). The lever 40 may then be released so that the lock pin 34 engages the base 20 and locks the support member 22 in the first use position. For example, referring to FIG. 1, the tool 18*a* may be laterally aligned with the sewing head 14 in the first use position. One or more similar sewing operations may then be performed using the desired tool (e.g., tool 18*a*), which may serve as a sewing guide and/or a poka-yoke feature.

Figure 4:
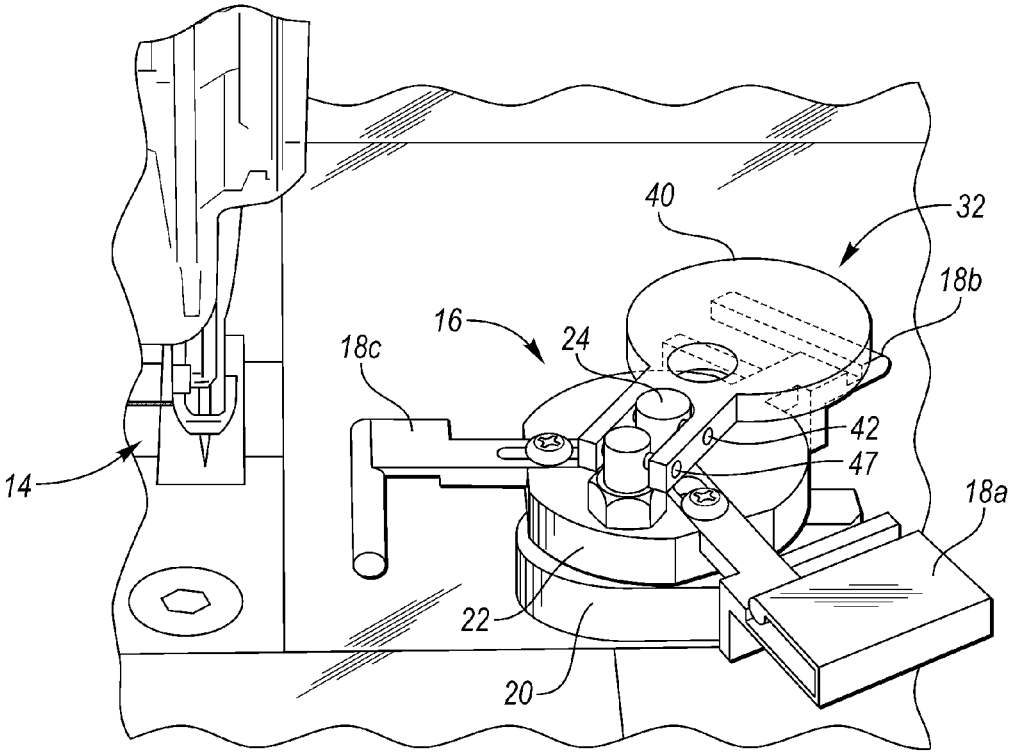
FIG. 4 is a fragmentary perspective view of the sewing machine showing the support member in a different use position compared to FIG. 1.

When it is desired to perform a different sewing operation, the operator may again push lever end 52 downwardly to move the lock pin 34 to the unlocked position, shown in phantom lines in FIG. 3, so that the support member 22 may be rotated (e.g., counter-clockwise) to a different or second use position, shown in FIG. 4, in which a different tool 18 (e.g., tool 18*c*) is positioned proximate the sewing head 14. The lever 40 may then be released again so that the lock pin 34 locks the support member 22 in the second use position.

One or more sewing operations may then be performed using the different tool (e.g., tool 18*c*).

It should be noted that connecting portions (e.g., connecting arms) of the tools 18*a*, 18*b*, 18*c* for connection with the support member 22 may vary in length, such that distal ends of the tools 18*a*, 18*b*, 18*c* may be spaced at different distances with respect to a center of the support member 22. For example, the tool 18*c* shown in FIG. 4 may be provided with a longer connecting arm such that the distal end (i.e., left end in FIG. 4) of the tool 18*c* may be positioned closer to the sewing head 14 than shown in FIG. 4. As another example, the length of the connecting arm of the tool 18*c* may configured so that the distal end of the tool 18*c* is positioned to the left of the sewing head needle shown in FIG. 4, such that a sew seam provided by the sewing head 14 may be positioned between the distal end of the tool 18*c* and the support member 22.

With the above guide assembly 16, tool changes may be handled quickly and efficiently. As a result, the same sewing machine 10 can be used for multiple different sewing operations that require different tools 18 (e.g., 18*a*, 18*b*, 18*c*). For example, as mentioned above, the support assembly 22 may be moved to any one of multiple different use positions in order to position any one of multiple different tools 18 proximate the sewing head 14, without requiring complete removal of any tools from the sewing machine 10 or mounting of any new tools on the sewing machine 10.

Figure 5:
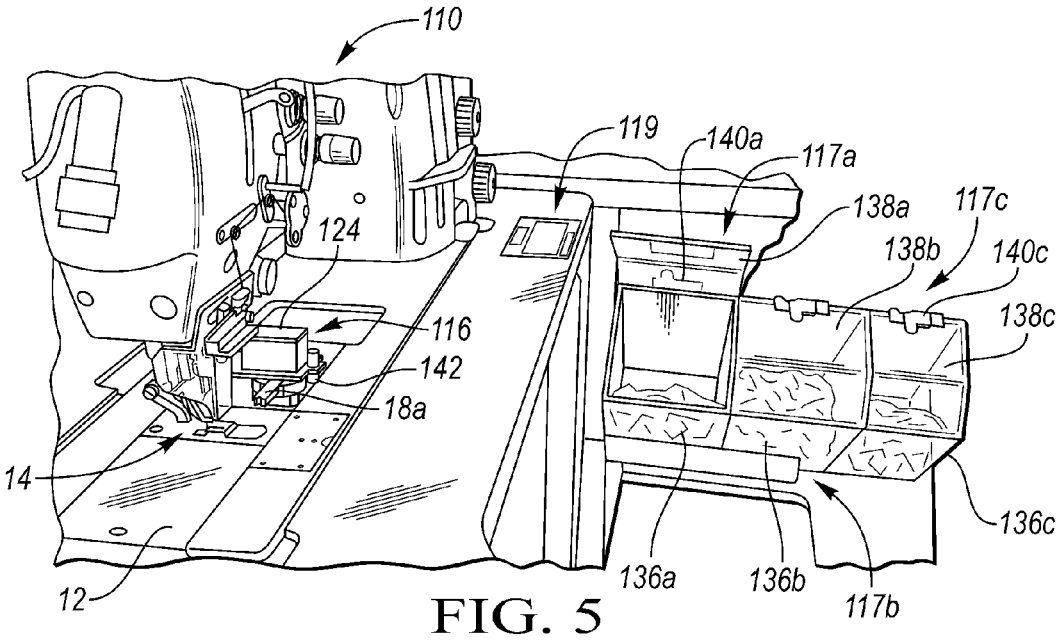
FIG. 5 is a fragmentary perspective view of a second embodiment of a sewing machine, according to the present disclosure, including a sewing head movably supported on a base, and a motorized guide assembly positioned proximate the sewing head.

FIG. 5 shows a second embodiment 110 of a sewing machine according to the present disclosure. Like the sewing machine 10, the sewing machine 110 may include a main body or base 12 and a sewing head 14 movably supported by, or otherwise associated with, the base 12. The sewing machine 110 further includes a motorized or automatic guide assembly 116 that is supported by, or otherwise associated with, the base 12 and configured to support multiple different tools 18 (e.g., tools 18*a*, 18*b*, 18*c* shown in FIGS. 1 and 4) for multiple different sewing operations, like the guide assembly 16 (a fragmentary view of tool 18*a* is shown in FIG. 5). In addition, the sewing machine 110 includes one or more lockable storage receptacles or bins 117 (e.g., 117*a*, 117*b*, 117*c*) for storing different parts (e.g., different fasteners, such as different sized (e.g., different lengths and/or widths) and/or different shaped retainers, clips, etc.) that may be used in the different sewing operations, and a control system or controller 119 for controlling operation of the sewing machine 10, as explained below in detail.

Figure 6:
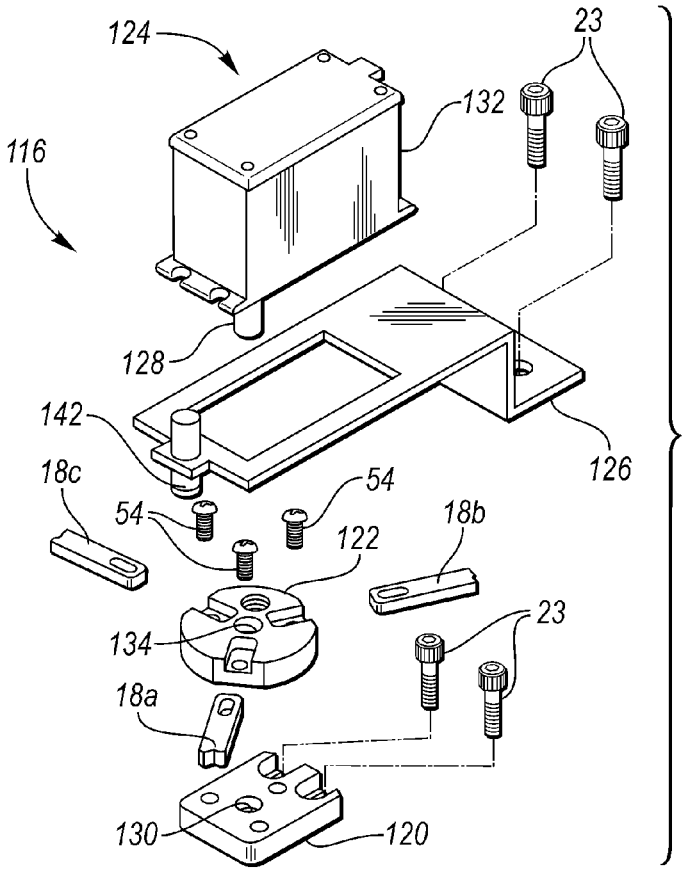
FIG. 6 is an exploded perspective view of the guide assembly shown in FIG. 5.

In the embodiment shown in FIGS. 5 and 6, the guide assembly 116 includes a base 120 that is attachable to the base 12, a support member 122 that is supported by the base 120 such that the support member 122 is movable with respect to the base 120 between multiple use positions (e.g., two or more use positions), a motor 124 for moving the support member 122, and a support bracket 126 that is attachable to the base 12 for supporting the motor 124. Furthermore, the support member 122 is configured to support the tools 18 such that a selected one of the tools 18 is useable for sewing operations when the support member 122 is positioned in each of the use positions, as explained above with respect to the guide assembly 16. Although fragmentary portions of the tools 18 are shown in FIG. 6, the tools 18 may have the same or similar configuration as the tools 18 shown in FIG. 1.

The base 120 and support bracket 126 may be attached to the base 12 in any suitable manner. In the embodiment shown in FIGS. 5 and 6, for example, the base 120 and support bracket 126 are each connected to the base 12 with multiple fasteners 23, such as bolts or screws.

Likewise, the support member 122 may be mounted on the base 120 in any suitable manner such that support member 122 is movable with respect to the base 120. For example, the support member 122 may be rotatably mounted on top of the base 120, with or without a rotation facilitation member (e.g., a washer or bearing) positioned between the support member 122 and the base 120, such that the support member 122 is rotatable between the use positions. As a more detailed example, the support member 122 may be mounted on a rotatable drive shaft 128 of the motor 124, and the driveshaft 128 may extend into an opening 130 formed in the base 120 such that the drive shaft 128 is rotatable with respect to the base 120. The motor 124 may further include a drive unit 132 for rotating the driveshaft 128 and support member 122, and the drive unit 132 may be attached to the support bracket 126 such that the drive unit 132 is positioned above the support member 122.

The support member 122 may be fixedly secured to the drive shaft 128 in any suitable manner such that the support member 122 is rotatable with the drive shaft 128. For example, the support member 122 and the driveshaft 128 may have a keyed connection. As a more detailed example, the drive shaft 128 may have a key feature (not shown) that is received in a key way (not shown) formed in an opening 134 of the support member 122, or the support member 122 may have a key feature (not shown) that is received in a key way (not shown) of the drive shaft 128. As another example, the support member 122 may be connected to the drive shaft 128 with a set screw.

In another embodiment, the guide assembly 116 may be provided without the base 120. For example, the support member 122 may be movably supported on the base 12 of the sewing machine 110. In such an embodiment, the drive shaft 128 may extend into an opening formed in the base 12.

Returning to FIG. 5, the controller 119 may include one or more processors and suitable software and/or suitable hardware for controlling operation of the sewing machine 110. More specifically, the controller 119 may be configured to control operation of one or more of the sewing head 14, the lockable bins 117 and the motor 124. For example, the controller 119 may be configured to communicate with the sewing head 14, the bins 117 and the motor 124 wirelessly or through wired connections in order to control their operation. As a more detailed example, the controller 119 may be used to select a desired use position of the guide assembly 116, and the controller 119 may then activate the motor 124 to automatically move the support member 122 to the desired use position.

Furthermore, the controller 119 may be configured to provide access to the storage bins 117 based on the position of the storage member 122. For example, the controller 119 may be configured to provide access to a particular one of the bins 117 associated with a particular one of the sewing operations when the support member 122 is positioned in a particular one of the use positions. As a more specific example, each bin 117 may include a main body 136 that defines a storage area, a cover 138 for covering the storage area, and a lock 140 that is configured to be in communication with the controller 119 and configured to lock the cover 138 in a closed position with respect to the main body 136. The controller 119 may be operable to unlock a respective one or none of the locks 140 according to the position of the support member 122, such that access to only one or none of the bins 117 is provided for each use position of the support member 122. The controller 119 may further be configured to rotate the support member 122 to a different use position only after the cover 138 of the bin 117 associated with the current use position is moved to the closed position and the associated lock 140 is re-engaged or otherwise re-activated.

As mentioned above, each tool 18 may be useable with a particular type of part that is stored in only one of the bins 117 (e.g., the parts in a particular bin 117 may all be the same or similar, while the parts in each bin may all be different, e.g., different size and/or different shape, than the parts in each other bin). For example, each tool 18 may be configured to receive a particular type of part and only in a particular orientation, such that the tool 18 provides a poka-yoke (i.e., mistake-proofing) function. As a result, each tool 18 may function as a part guide for guiding a particular type of part into a desired position for a particular sewing operation. Alternatively or in addition, each tool 18 may function as a sewing guide during a particular sewing operation to ensure proper spacing of parts being joined together and/or to ensure proper location of a sewn stitch or seam.

Furthermore, the controller 119 may initially be calibrated or otherwise programmed such that each use position of the support member 122 is correlated with a particular one or none of the bins 117. As another option, each tool 18 may have an identifier, and the sewing machine 110 may further include a sensor 142 that is in communication with the controller 119 and configured to sense or otherwise detect the identifiers. The controller 119 may then be configured to provide access to a particular bin 117 (e.g., unlock a cover of the bin) based on the tool 18 detected by the sensor 142 in a particular use position of the support member 122. As a more detailed example, each tool 18*a*, 18*b*, 18*c* may have a different color (e.g, be painted a different color), and the sensor 142 may be a color sensor that is able to distinguish between the tools based on sensed color. Alternatively, each tool 18*a*, 18*b*, 18*c* may have any suitable identifier (e.g, bar code, magnetic chip, electronic chip, radio-frequency identifier (RFID), etc.), and the sensor 142 may be any suitable sensor (e.g., bar code reader, magnetic sensor, capacitive sensor, RFID sensor, etc.) that is able to detect the identifiers in order to distinguish between the tools 18*a*, 18*b*, 18*c*.

An example method of mounting the guide assembly 116 onto the base 12 will now be described with reference to FIGS. 5 and 6. First, the base 120 of the guide assembly 116 may be secured to the base 12 of the sewing machine 110 using the fasteners 23. Next, the support member 122 having the tools 18 mounted thereon may be positioned on the base 120 such that the openings 130 and 134 are aligned. The support bracket 126 having the motor 124 mounted thereon may then be attached to the base 12 such that the drive shaft 128 extends through the opening 134 of the support member 122 and into the opening 130 of the base 120. Next, the motor 124 may be connected to the controller 119.

The above steps may instead be performed in any suitable order that allows assembly of the guide assembly 116, and mounting of the guide assembly 116 onto the base 12 of the sewing machine 110. For example, the motor 124 may be attached to the support bracket 126 after the support bracket 126 has been attached to the base 12.

An example method of operating the sewing machine 110 will now be described with reference to FIGS. 5 and 6. First, an operator may select a desired first sewing operation or a desired first use position for the guide assembly 116 on an input screen or input device of the controller 119. The controller 119 may then automatically activate the motor 124 to move the support member 122 to the selected first use position in which a desired tool 18*a*, 18*b*, or 18*c* is positioned proximate the sewing head 14 (e.g., aligned with the sewing head 14). For example, referring to FIG. 5, the tool 18*a* may be aligned with the sewing head 14 in the first use position. The controller 119 may also unlock the lock 140 of the bin 117 (e.g., bin 117*a*) associated with the selected first use position, so that the operator may move the cover 138 of the bin 117 to an open position and gain access to parts stored in the associated main body 136 of the bin 117. One or more similar sewing operations may then be performed using the desired tool 18 (e.g., tool 18*a*) and desired parts from the associated bin 117 (e.g., 117*a*).

When it is desired to perform a different sewing operation, the operator may select a second sewing operation or a second use position for the guide assembly 116 on the input screen or input device of the controller 119, and close the cover 138 of the bin 117 associated with the first sewing operation. The controller 119 may then automatically activate the motor 124 to move the support member 122 to the selected second use position in which a different tool 18 (e.g., tool 18*b* or 18*c*) is positioned proximate the sewing head 14 (e.g., aligned with the sewing head 14). The controller 119 may also unlock the lock 140 of the bin 117 (e.g., bin 117*b* or 117*c*) associated with the selected second use position, so that the operator may move the cover 138 of the bin 117 to an open position and gain access to parts stored in the associated main body 136 of the bin 117. The controller 119 may instead not unlock any of the locks 140 if a part from one of the bins 117 is not needed for the second sewing operation.

The controller 119 and/or motor 124 may also be configured to stop rotating the drive shaft 128 in a particular direction if sufficient resistance to rotation is encountered (e.g., something is in contact with the support member 122 and/or one of the tools 18). In such a case, the controller 119 and/or motor 124 may further be configured to rotate the drive shaft 128 in an opposite direction to return the support member 122 to the last use position. For example, the controller 119 and/or motor 124 may include a current sensing device or sensor that is operable to measure electrical current supplied to the drive unit 132, and the controller 119 and/or motor 124 may include suitable software for carrying out the above functions if current above a threshold level is detected, which may be indicative of a blockage.

The guide assembly 116 of the sewing machine 110 provides similar benefits as the guide assembly 16 of the sewing machine 10. In addition, the motor 124 of the guide assembly 116 enables automatic adjustment or positioning of the associated support member 122, such that a separate locking device is not needed to hold the support member 122 in each of the desired use positions. Therefore, referring to FIG. 6, the threaded opening shown in the support member 122 may be deleted.

Furthermore, use of the bins 117 that may be controlled by the controller 119 ensures that only the correct parts, if any, associated with a particular sewing operation and use position of the support member 122 may be accessed. As a result, accuracy of sewing operations may be improved.

In another embodiment, the guide assembly 116 may be used without the controller 119 and/or the bins 117. For example, the motor 124 may include a control switch that may be actuated to automatically move the support member 122 between the various use positions.

The components of the guide assemblies 16 and 116 may be made of any suitable material and in any suitable manner. For example, the associated bases 20, 120 and support members 22, 122 may be made of metal or molded plastic. Furthermore, the components of the guide assembly 16 and 116 may have any suitable configuration. For example, the support members 22 and 122 may be formed as a generally round or disk-shaped, flat or planar parts.

In addition, features of the above embodiments may be combined to form further embodiments according to the disclosure. For example, the sewing machine 10 may be provided with lockable storage receptacles or bins and a control system or controller, such as the lockable bins 117 and controller 119 described above with respect to the sewing machine 110. Since the guide assembly 16 of the sewing machine 10 is manually operated, however, the controller for the sewing machine 10 would not be used to control movement of the support member 22.

The sewing machine 10 may also be provided with a poka-yoke (i.e., mistake-proofing) feature for facilitating proper bin and part selection for different sewing operations. For example, each tool 18 may have an identifier, and the sewing machine 10 may further include a sensor 58 that is in communication with the above described controller and configured to sense or otherwise detect the identifiers, such as described above with respect to the sewing machine 110. The controller may then be configured to provide access to a particular bin (e.g., unlock a cover of the bin) based on the tool 18 detected by the sensor 58 in a particular use position of the support member 22. As a more detailed example, each tool 18*a*, 18*b*, 18*c* may have a different color (e.g, be painted a different color), and the sensor 58 may be a color sensor that is able to distinguish between the tools based on sensed color. Alternatively, each tool 18*a*, 18*b*, 18*c* may have any suitable identifier (e.g, bar code, magnetic chip, electronic chip, radio-frequency identifier (RFID), etc.), and the sensor 58 may be any suitable sensor (e.g., bar code reader, magnetic sensor, capacitive sensor, RFID sensor, etc.) that is able to detect the identifiers in order to distinguish between the tools 18*a*, 18*b*, 18*c*. If the bin that is currently accessible by an operator does not correspond to the tool identified in the current use position of the support member 22, the controller may be configured to not allow the sewing machine 10 to operate (e.g, deactivate the sewing head 14) until the support member 22 is rotated to the correct use position.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sewing machine comprising:

a sewing head for performing sewing operations;

a base; and a support member that is movable with respect to the base between multiple use positions, the support member being configured to support multiple different tools such that a selected one of the tools is useable in a sewing operation when the support member is positioned in each of the use positions;

wherein the use positions of the support member include a first use position for positioning a first tool of the multiple different tools proximate the sewing head during a first sewing operation, and a second use position for positioning a second tool of the multiple different tools proximate the sewing head during a second sewing operation, and wherein the second tool has a different configuration than the first tool.

2. The sewing machine of claim 1 wherein the support member is rotatably mounted on the base.

3. The sewing machine of claim 2 further comprising a locking device for locking the support member in each of the use positions.

4. The sewing machine of claim 3 wherein the base includes multiple lock features, and the locking device includes a lock pin that is extendable through the support member and cooperable with one of the multiple lock features when the support member is in each of the use positions.

5. The sewing machine of claim 4 wherein each of the multiple lock features comprises a tapered opening.

6. The sewing machine of claim 4 wherein the support member is rotatably mounted on a spindle that is connected to the base, and the locking device further includes a lever that is associated with the spindle and connected to the lock pin, and wherein the lever is operable to move the lock pin from a locked position, in which the lock pin is engaged with one of the multiple lock features, to a unlocked position, in which the lock pin is disengaged from the multiple lock features.

7. The sewing machine of claim 6 wherein the lever is pivotable with respect to the spindle.

8. The sewing machine of claim 7 wherein the lever defines an opening that receives the spindle.

9. The sewing machine of claim 8 wherein the lever is pivotally connected to the spindle and pivotally connected to the lock pin.

10. The sewing machine of claim 1 further comprising a sewing head for performing sewing operations, a control system associated with the sewing head and a sensor associated with the control system for detecting which of the multiple tools is positioned proximate the sewing head when the support member is in a particular use position.

11. The sewing machine of claim 10 further comprising multiple lockable bins associated with the control system and configured to store parts that are useable in different sewing operations, wherein the control system is operable to unlock a particular one of the bins based on the tool detected by the sensor.

12. A sewing machine comprising:

a base;

a support member that is movable with respect to the base between multiple use positions, the support member being configured to support multiple tools such that a selected one of the tools is useable in a sewing operation when the support member is positioned in each of the use positions;

a motor connected to the support member for moving the support member between the use positions;

a control system for controlling operation of the motor; and multiple lockable bins associated with the control system and configured to store parts that are useable in different sewing operations;

wherein the control system is operable to unlock a particular one of the bins associated with a particular one of the sewing operations when the support member is positioned in a particular one of the use positions.

13. The sewing machine of claim 12 wherein the control system is configured to control position of the support member based on a desired sewing operation.

14. The sewing machine of claim 12 wherein the support member is rotatable with respect to the base, and the motor is operable to rotate the support member between the use positions.

15. The sewing machine of claim 14 wherein the motor includes a drive unit positioned above the support member, and a drive shaft that is configured to be driven by the drive unit, wherein the drive shaft is connected to the support member and extends into the base such that the drive shaft is rotatable with respect to the base.

16. The sewing machine of claim 14 further comprising a control system for controlling operation of the motor, and multiple lockable bins associated with the control system and configured to store parts that are useable in different sewing operations, wherein the control system is operable to unlock a particular one of the bins associated with a particular one of the sewing operations when the support member is positioned in a particular one of the use positions.

17. A movable support assembly for use with a sewing machine that includes a sewing head for performing sewing operations, the support assembly being configured to support multiple tools including a first tool and a second tool having a different configuration than the first tool, wherein each of the first and second tools is configured to receive a part to be sewn to another part and/or to function as a sewing guide during a sewing operation, the support assembly comprising:

a support member that is movably attachable to the sewing machine such that the support member is movable between multiple use positions; and multiple attachment members that are attachable to the support member and configured to support the multiple tools such that a selected one of the tools is useable when the support member is positioned in each of the use positions;

wherein the use positions of the support member include a first use position for positioning the first tool proximate the sewing head during a first sewing operation, and a second use position for positioning the second tool proximate the sewing head during a second sewing operation.

18. The sewing machine of claim 1 wherein the sewing machine includes the multiple different tools, and each tool is configured to receive a part to be sewn to another part and/or to function as a sewing guide during a sewing operation.

19. The sewing machine of claim 1 wherein the sewing head is positionable laterally outside of the support member during the sewing operations.

20. The sewing machine of claim 1 further comprising a motor connected to the support member for moving the support member between the use positions.

21. The support assembly of claim 17 further comprising a motor configured to connect to the support member for moving the support member between the use positions.

* * * * *